US005114084A

United States Patent [19]

Yamaguchi et al.

[11] Patent Number: 5,114,084

[45] Date of Patent: May 19, 1992

[54] CRUSHING MACHINE

[75] Inventors: Harumi Yamaguchi; Takeshi Higuchi, both of Kitakyushu; Kenji Fukuda, Shingu, all of Japan

[73] Assignee: Nippon Magnetics USA, Inc., Stamford, Conn.

[21] Appl. No.: 644,951

[22] Filed: Jan. 23, 1991

[30] Foreign Application Priority Data

Jan. 31, 1990 [JP] Japan ..... 2-8455

[51] Int. Cl.[5] ..... B02C 17/02; B02C 17/24

[52] U.S. Cl. ..... 241/178; 241/180; 241/182

[58] Field of Search ..... 241/176-180, 241/182-184; 51/164.1

[56] References Cited

U.S. PATENT DOCUMENTS 1,172,626 2/1916 Moussette ..... 241/178 X 1,479,172 1/1924 Cole et al. ..... 241/178 X

FOREIGN PATENT DOCUMENTS 1003597 12/1979 Japan .

OTHER PUBLICATIONS

Japanese Gazette No. 31-8738, "Coal Screening Mill", Honda, Oct. 12, 1956.

Japanese Gazette No. 52-33163, "Crusher", Hashimoto, May 14, 1977.

*Primary Examiner*—Mark Rosenbaum

*Attorney, Agent, or Firm*—Hoffmann & Baron

[57] ABSTRACT

The present invention is a crushing machine including a rotatable housing having an inlet port and a discharge port and including an independent crushing means inside the housing. Support rings each of which is at least 1.8 times larger than the housing, circumscribe the housing and are fixed thereto. The support rings are engagable with a driving means for rotating the housing. The support rings support and distribute the weight of the housing on the driving means.

9 Claims, 2 Drawing Sheets

CRUSHING MACHINE

BACKGROUND OF THE INVENTION

The present invention relates to cylindrical or barrel type crushing machines. More particularly, the present invention relates to crushing machines having a rotatable housing with crushing members contained inside.

The function of crushing machines, to which the present invention relates, is to crush stones, steel slags, gravel, or sand, and to screen these materials to provide a desired size of particulate. The crushing machine includes driving means for rotating the housing, thereby engaging the crushing members with the materials in the housing.

Prior art conventional crushing machines exist for pulverizing rocks or other materials into sand or the like. These crushing machines are of a barrel type. Barrel type crushing machines include both side walls and multiple rods installed in a rotating cylinder. The rotating cylinder, in turn, has an inlet port in the side of said wall, and a discharge port in a peripheral wall.

One disadvantage with the conventional barrel type crushing machine is the time necessary to maintain and adjust a trunnion which receives the rotating cylinder. Another disadvantage is that installation requires special technical skills.

Moreover, since the machine is used in dusty areas with a rotating cylinder driven by gears and/or belts and supported with free rotation by bearings at both ends, the dust impedes and damages the exposed bearings, causing the metal to burn and grease to leak.

Another disadvantage with the conventional barrel type crushing machine is the necessity of providing a pit under the discharge port of the rotating cylinder in order to place an equipment such as a belt conveyor for transferring the crushed material. The necessity for providing a pit increases the cost required for installation and maintenance of the crushing machine.

Japanese Patent No. 1,003,597 shows a sand machine which has side walls on both sides of a rotating cylinder. The inlet port for stones is in one side wall and a discharge port for ejecting the crushed sand is in the other side wall. Two pairs of semicircular rings are mounted on the periphery of the rotating cylinder. The lower part of the rings rests on the rubber tires that are connected to a power source. The sand machine of this type is so designed that stones are charged into the rotating cylinder together with water, crushed by the rods inside, and then discharged from the discharge port.

In this particular type of machine, however, the rings have a diameter of only 1.5 times that of the rotating cylinder. As a result, the load applied on the rubber tires is large. Furthermore, the efficiency of transferring the power from the rubber tires to the rings is poor because the diameter of the rings is small.

Another drawback of this particular sand machine is the location of the discharge port. The discharge port is placed in one side of the side wall, and this makes it difficult to crush the stones or steel slags into the gravel of desired size. Even if the discharge port is moved to the center of the rotating cylinder, the cylinder is installed too low to place an equipment to transfer the discharged materials under the cylinder without making a pit, requiring a troublesome installation.

It is an object of the present invention to provide a crushing machine that dose not require expensive or frequent maintenance.

It is another object of the present invention to eliminate the effect of dust on the machine's performance.

Yet another object of the present invention to make it unnecessary to have a pit under the discharge port for allowing equipment under the machine.

A further object of the present invention is to increase the efficiency of the power transferred from the housing.

It is still further object of the present invention to place the discharge port in a position to effect ease of crushing stones or steel slags into the desired size.

Another object of the present invention is to decrease vibration of the housing, thereby preventing the internal crushing means from being displaced.

It is yet another object of the present invention to eliminate bearing and critical adjustment thereof.

It is also an object of the present invention to eliminate direct gearing between the housing and the driving means.

SUMMARY OF THE INVENTION

The present invention is a crushing machine which includes a rotatable housing with a perimeter, an inlet port and a discharge port, and an independent crushing means inside the rotatable housing. Circumscribing the rotatable housing at least two support rings are fixed thereto, each of which has a diameter at least 1.8 times larger than that of the rotatable housing and is engagable with a driving means for rotating the housing. The driving means is arcuately mounted around said support rings. The support rings are driven by the driving means frictionally engaging the rings. Further, the driving means distributes the weight of the rotatable housing and its contents.

As a result of the present invention, a crushing machine is provided with advantages over the prior art including easier installation, and less maintenance. Furthermore, the present crushing machine has enchanced reliability, efficiency, and cost effectiveness.

In particular, the crushing machine of the present invention reduce vibration by using tires for power trasmition to the rotatable housing. Using tires as the driving means eliminates adjustment and maintenance associated with the use of bearings.

The present invention further has at least two large support rings around the rotatable housing. The support rings provide an increased surface area for contacting the tires. The increased surface area reduces the pressure on the tires and enables the tires to support a heavier housing.

Further, because the contacting area between the driving tires and the support rings is increased, the torque-transmitting force is increased and, as a result, a smooth rotation is obtained.

Additionally, the crushing machine of the present invention has large-diameter support rings and this enables the placement of an equipment to transfer the crushed materials from under the rotatable housing without the need of a pit requiring a special installation work, because said support rings work as the legs of the rotatable housing and lift it above the installation level each of which has a diameter at least 1.8 times higher than that of the rotatable housing.

For a better understanding of the present invention, together with other and further objects, reference is made to the following description, taken together with the attached drawings, and its scope will be pointed out in the appended claims.

DETAILED DESCRIPTION

Figure 1:
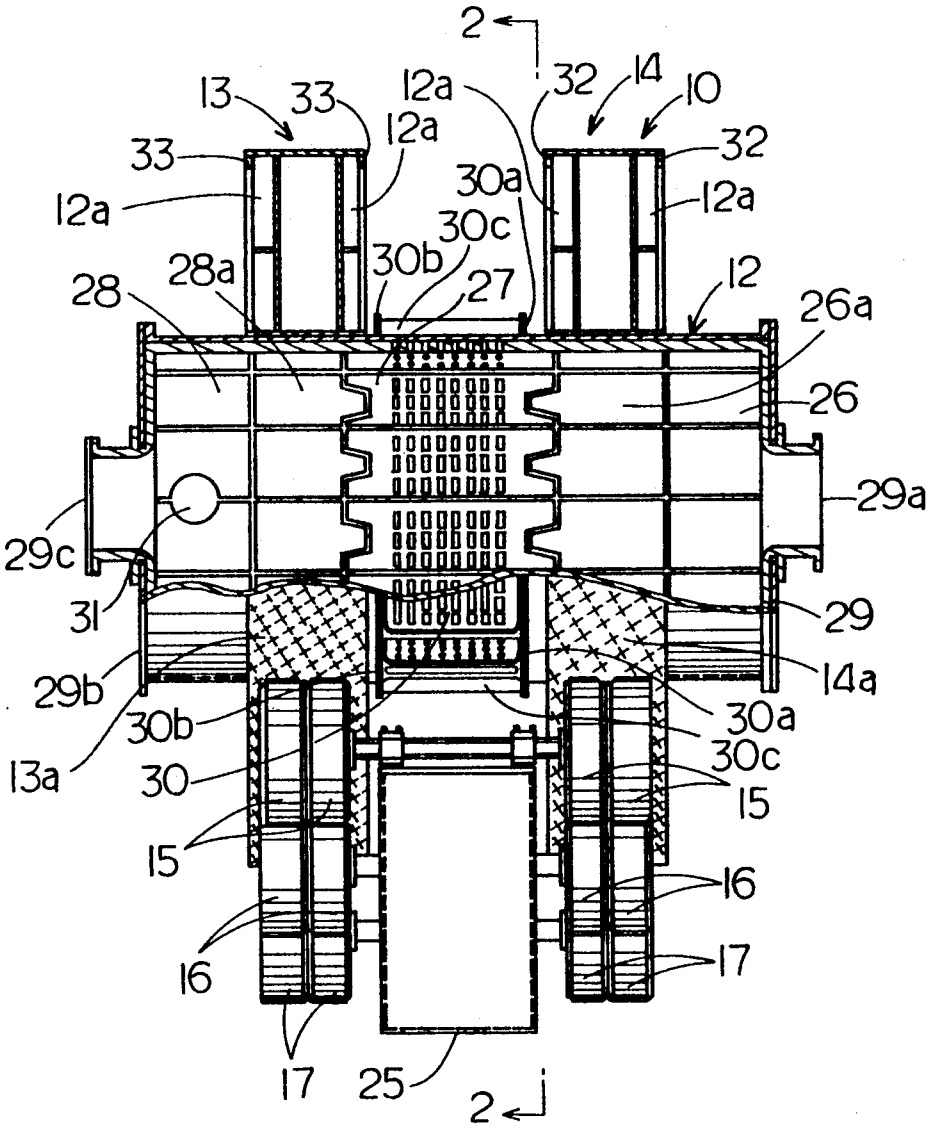
FIG. 1 is an elevated view in partial section of the crushing machine according to the present invention.
Figure 2:
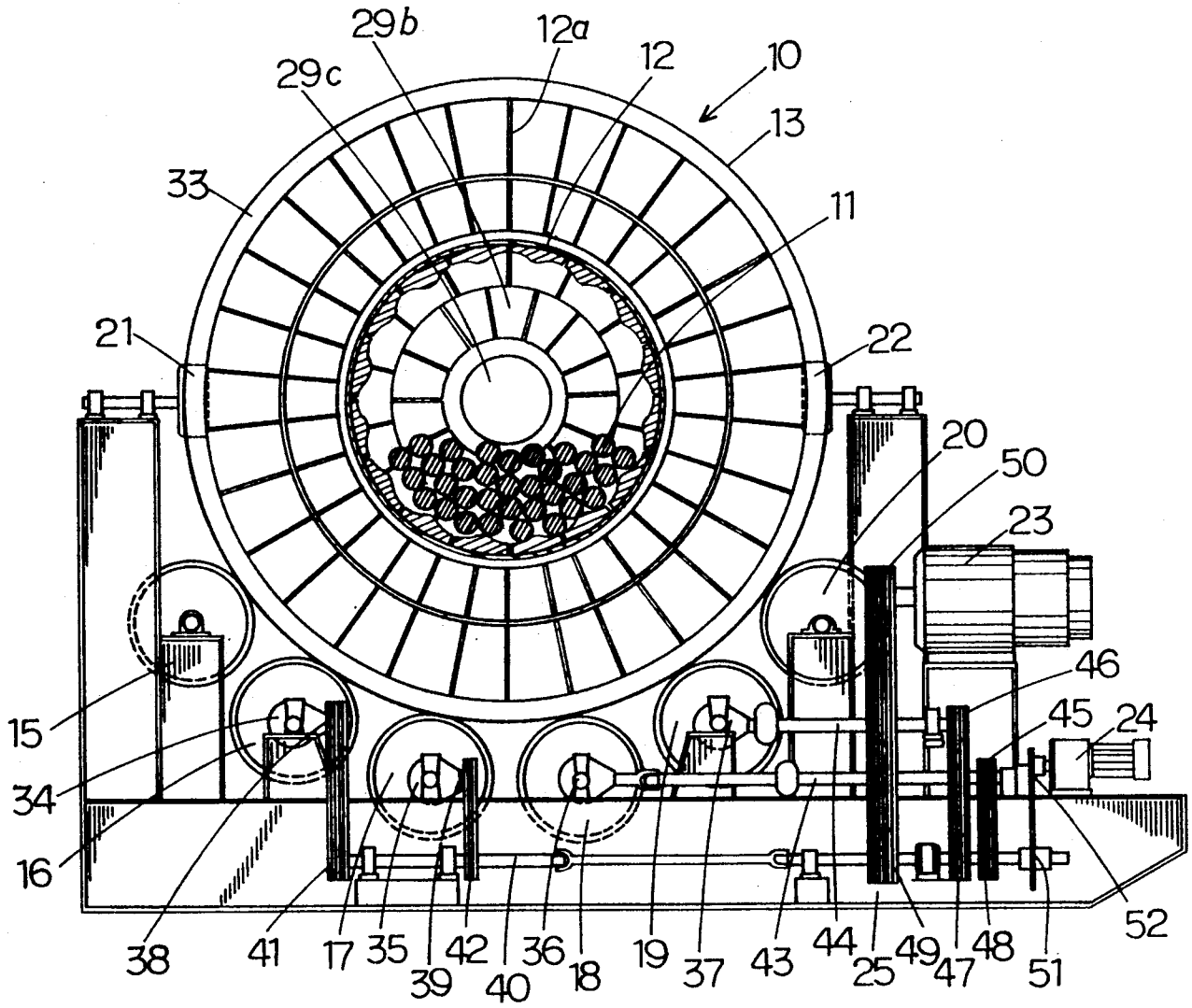
FIG. 2 is a view 2—2 of FIG. 1 showing the structure of the support rings, as well as the relation between the tires and the rings.

A crushing machine 10 shown in FIGS. 1 and 2 is an illustration of one embodiment of the present invention. The crushing machine 10 as shown in FIG. 1 has a rotatable housing 12 in which a multiplicity of rods 11 is provided, support rings 13, 14 provided symmetrically on both sides of said rotatable housing 12, air-cushioning pair tires 15, 16, 17, 18, 19 and 20 for receiving said support rings 13, 14, thrust tires 21, 22 provided respectively on both outsides of said support rings 13, 14, a driving motor 23 for driving said tires 16, 17, 18 and 19, a speed reducing motor 24 for inching, and a bed 25 on which said components are installed.

Then the details of these components will be explained hereinunder.

The rotatable housing 12 is an iron cylinder having a circular cross section, and the lining plates **26, 26*a*, 27, 28, and 28*a* made of wear-resistant steel are disposed inside of the rotatable housing 12**.

For discharging the crushed materials out of the rotatable housing 12, the center lining plates 27 and the portion of the rotatable housing 12 where said center lining plates 27 are overlapping have a discharge port 30 having a number of long apertures which can have a dimension on the order of about 40 mm × 120 mm. To reinforce the periphery of the rotatable housing 12 which is weakened due to the discharge port 30, round plates **30*a*, 30*b* are mounted respectively on both sides of the discharge port 30, and said round plates 30*a*, 30*b* are connected to a multiplicity of rib plates 30*c* surrounding the rotatable housing 12**.

The lining plate 28 and the portion of the rotatable housing 12 where said lining plate 28 is overlapping have four ore-discharge ports (only one ore-discharge port 31 is shown in FIG. 1) to discharge coarses grains or large grains out of the rotatable housing 12. The rotatable housing 12 additionally includes an inlet port **29*a* and a inspection port 29*c*. The inlet port 29*a* is located in the one side-wall 29 of the rotatable housing 12. The inspection port 29*c* is located in the other side-wall 29*b*. The inside wall of side-walls 29, 29*b* of the rotatable housing 12** are lined with wear-resistant lining plates.

Via a multiplicity of support rib plates **12*a* spaced symmetrically and placed circumferentially around the rotatable housing 12, the support rings 13, 14 are mounted. The support rings 13, 14 are provided respectively on both side portions of the rotatable housing 12, and are approximately two times larger in diameter (at least 1.8 times larger) than the rotatable housing 12 so as to increase the area against which the tires 15–20 bear. This reduces the pressure per square inch exerted on the tires by the rotatable housing 12 and, additionally, raises the mounted height of the rotatable housing 12** to provide a room for an equipment such as a belt conveyor to transfer the crushed materials ejected from the discharge port.

On the surface of said support rings 13, 14, checkered steel plates **13*a*, 14*a* are provided so as to prevent the slippage between the support rings and the driving means. At the both ends of said support rings 13, 14, the round plates 32, 33 are provided to contact with said thrust tires 21, 22. The thrust tires 21, 22 prevent the rotatable housing 12** from moving in the lateral direction.

The support rings 13, 14 bear against the tires 15–20 and are driven thereby. The tires 15, 20 at the opposite peaks of the arcuate are free-wheeling and are not used to drive the crushing machine. The tires 16–19 which are located below the peak tires 15, 20 are connected with differential gears 34–37 respectively, at the center of each tire. Pulleys 38, 39 are set on the input shaft of the differential gears 34, 35 respectively and are connected by belts with pulleys 41, 42 set on the rotating drive shaft 40. Pulleys 45, 46 are placed on the input shaft of the differential gears 36, 37 respectively through the intermediate shafts 43, 44 and connected by belts with pulleys 47, 48 set on the rotating drive shaft 40.

The rotating drive shaft 40 includes a pulley 49 connected by belt to another pulley 50 set on the driving motor 23 an further includes a removable sprocket 51 connected by chain to another sprocket 52 connected to the output shaft of the speed reducing motor 24.

In order to drive the crushing machine 10 shown in FIGS. 1 and 2 in a circular motion, the tires 15–20 must maintain contact with the support rings 13, 14 by friction. Thus, the tires 16–19 are able to drive the support rings 13, 14 thereby rotating the rotatable housing 12. The checkered steel plates **13*a*, 14*a* on the support rings 13, 14 enhance the frictional contact between the tires 16–19 and the support rings 13, 14. Additionally, using friction contact between the tires 16–19 and support rings 13, 14 to drive the rotatable housing 12** eliminates the need for gearing and bearings. The elimination of bearings abolishes the need for centering and eliminates metal seizure.

Furthermore, the air inflation of the tires 15–20 reduces vibration of the housing. The multiple rods 11 inside the rotatable housing 12 crush the steel slags or other materials charged into the rotatable housing through the inlet port **29*a*. Crushed materials are then discharged through the discharge port 30**. Thus, the installation, operation, and maintenance of the machine are simplified and are, consequently, less expensive.

Therefore the operating procedure of this crushing machine 10 is first to start the driving motor 23 to make the right and left tires 16–19 start rotating in a certain direction, thereby driving the rotatable housing 12. Next, the rods 11 crush materials (slags, for example) charged from the inlet port **29*a*. Materials are moved gradually toward the discharge port 30 at the center. Finally the materials are discharged to the outside through the chute which does not appear in the illustration. Any uncrushed materials such as iron lumps are discharged outside as they are through the ore-discharging port 31**.

Testing of this crushing machine 10 is performed first by stopping the driving motor 23, and then installing the removable sprocket 51 on the drive shaft 40. Then testing is completed by starting the speed reducing motor 24 and turning the rotatable housing 12 slowly.

In this illustrated preferred embodiment, the major discharge port is placed at the center of the rotatable housing. However it is possible to place the discharge port at the mouth or at the end of the rotatable housing. Another possibility is to place the discharge holes at the mouth, at the center, and at the end of the rotatable housing with different opening sizes to add a screening effect that will separate the size of the grains to be discharged.

While there have been described what are presently believed to be the preferred embodiments of the invention, those skilled in the art will recognize that changes and modifications may be made thereto without departing from the spirit of the invention, and it is intended to claim all such changes and modifications as fall within the true scope of the invention.

What is claimed is:

1. A crushing machine comprising:

a rotatable housing having a perimeter of constant diameter, an inlet port and a discharge port, said rotatable housing including a multiplicity of lining plates, one of said multiplicity of lining plates forming a center lining plate and having a number of apertures for discharge of crushed material, said center lining plate thereby forming said discharge port, said rotatable housing further having at least two round plates mounted on both sides of said center lining plate and connected to a multiplicity of rib plates surrounding said rotatable housing, independent crushing means provided in said rotatable housing which upon rotation of said rotatable housing, crushes materials introduced into said rotatable housing, support rings circumscribing said rotatable housing and fixed thereto for driving said rotatable housing, and having a diameter over the length thereof of at least 1.8 times larger than that of said rotatable housing, and driving means arcuately mounted around said support rings respectively to support said support rings and drive said support rings by frictional engagement therewith, said driving means including at least four members having a surface for frictional engagement with said support rings and a motor connector for rotatively driving said members, whereby said support rings distribute the weight of said rotatable housing and its contents, and said support rings and said rotatable housing are consequently rotatably driven.

2. The crushing machine of claim 1, wherein said independent crushing means comprises a plurality of rods inside said rotatable housing.

3. The crushing machine of claim 1, wherein said support rings further comprises a patterned surface for enhanced frictional engagement with said driving means.

4. The crushing machine of claim 1, further comprising at least two thrust tires fixed on said crushing machine, said thrust tires contacting said support rings and thereby preventing non-rotational movement when said support rings are rotatably driven.

5. The crushing machine of claim 4, wherein said thrust tires are positioned along a diametrical line passing through said support ring.

6. The crushing machine of claim 5, wherein said diametrical line is perpendicular to a direction of gravity.

7. The crushing machine of claim 1, wherein one of said multiplicity of lining plates forms a side lining plate and further comprising an outlet port for discharge of uncrushed material, said outlet port formed in said side lining plate.

8. The crushing machine of claim 1, further comprising an inspection port, said inspection port allowing viewing of said crushed material.

9. The crushing machine of claim 1, wherein said independent crushing means comprises a plurality of rods inside said rotatable housing; and wherein said support rings comprise a patterned surface for enhanced frictional engagement with said driving means; and further comprising at least two thrust tires fixed on said crushing machine, said thrust tires contacting said support rings and thereby preventing non-rotational movement when said support rings are rotatably driven, said thrust tires positioned along a diametrical line passing through said support ring, said diametrical line being perpendicular to a direction of gravity; and wherein one of said multiplicity of lining plates forms a side lining plate and further comprising an outlet port for discharge of uncrushed material, said outlet port formed in said said lining plate; and further comprising an inspection port, said inspection port allowing viewing of said crushed material.

* * * * *